US005172114A

United States Patent [19]

Bedoya et al.

[11] Patent Number: 5,172,114

[45] Date of Patent: Dec. 15, 1992

[54] TACTILE EFFECT SWITCH AND KEYBOARD USING SUCH A SWITCH

[75] Inventors: Claude Bedoya, Montigy-le-Bretonneux; Alain Cognard, Antony, both of France

[73] Assignee: Sextant Avionique, France

[21] Appl. No.: 665,045

[22] Filed: Mar. 6, 1991

[30] Foreign Application Priority Data

Mar. 8, 1990 [FR] France ..... 90 02925

[51] Int. Cl.[5] ..... H01H 9/00; H01H 13/26

[52] U.S. Cl. ..... 341/27; 341/34; 200/5 R; 200/513; 200/521

[58] Field of Search ..... 341/27, 22, 34; 200/5 A, 5 R, 511, 512, 513, 521

[56] References Cited

U.S. PATENT DOCUMENTS 4,677,268 6/1987 Nemeth ..... 200/513
4,764,770 8/1988 Church ..... 341/22
4,814,561 3/1989 Kawasaki ..... 200/513

FOREIGN PATENT DOCUMENTS 2448587 4/1975 Fed. Rep. of Germany ..... 341/27

*Primary Examiner*—Donald J. Yusko
*Assistant Examiner*—Michael Krakovsky
*Attorney, Agent, or Firm*—William A. Drucker

[57] ABSTRACT

In the tactile effect switch and a keyboard using such a switch, the tactile effect is obtained by combining a snap acting switch and the deformation of a stud, axially deformable under compression, which is integrally formed on a membrane made from a resilient material disposed on a support plate and which provides a resilient connection between a key and the switch in the manner of a pusher.

7 Claims, 2 Drawing Sheets

TACTILE EFFECT SWITCH AND KEYBOARD USING SUCH A SWITCH

BACKGROUND OF THE INVENTION

1. Field of the Invention

The present invention relates to a unitary sealed tactile effect key, particularly for a keyboard of the type comprising:

- a support plate with recesses each adapted for receiving switch elements,
- a printed circuit for electric connection of said switch, this printed circuit possibly forming said support plate,
- a molded spacer integral with the support plate and comprising, between dividing walls, a housing having at least one upper opening in which is housed a key-pusher assembly mounted for sliding in said housing and in mechanical connection with the switch,
- deformable means associated with said key-pusher-switch assembly for giving the user a tactile feeling.

2. Description of the Prior Art

A keyboard with keys of this type is known, in which said deformable means are formed by a flexible membrane common to all the keys and placed above the support plate for protecting the recesses and ensuring the resilient return of the keys to which said membrane is connected by nipping with an element of the switch.

The major drawback of this type of keyboard resides in the fact that the flexible membrane as well as the support plate are formed with a multiplicity of openings, in number equal to the number of switches equipping the keyboard. Thus, after a certain number of operations, overstretching of the material occurs which, associated with ageing in time thereof, no longer allows the membrane to provide sealing of the unit. In addition, the tactile effect obtained in this type of known keyboard is not controlled. In fact, it is due to the resistance of the membrane alone, which is deformed laterally under the effect of an axial thrust on the key, to which is added that of a spring element of the switch until the latter rocks.

Such rocking allows the operator to feel by tactile effect that his operation has been taken into account. On the other hand, beyond such rocking, a certain overtravel producing a certain comfort in use is only obtained by crushing of the membrane in a limited and uncontrolled way.

From the patent DE-A-2 828 435, it has also been proposed to insert a damping element between the key and the element actuating the switch. However, this solution, which only shifts the response curve of the actuating element of the switch, does not allow the desired result to be obtained.

SUMMARY OF THE INVENTION

The purpose of the invention is more particularly to overcome these drawbacks and provide the user with a keyboard with perfectly sealed keys having a tactile effect which is controlled during the whole operating time.

For this, it provides a tactile effect switch comprising:

- a support having a recess adapted for receiving a switch element which can be actuated under the effect of a pressure exceeding a given force threshold,
- a resilient membrane integral with the support which forms a cap closing the recess, this membrane having, on the side opposite the recess and substantially coaxially therewith, a resiliently deformable stud which serves as pusher,
- a key associated with the pusher, on which a force may be exerted for actuating the switch element.

According to the invention, this switch is characterized in that the stud is made from a resiliently deformable material with a low modulus of elasticity and the key is formed so as to limit the expansion of the stud from a given expansion rate, so as to obtain the following successive operating phases:

- a pre-travel phase during which the resistant force exerted by the key on the finger of the user increases progressively until the force applied to the key reaches the force threshold,
- an active phase during which the travel of the key is practically zero and actuation of the switch is due to partial expansion of the material of the stud, the resistant force decreasing suddenly while producing a feeling of release,
- an over-travel phase at the beginning of which the resistant force increases again progressively then rises suddenly when the conformations of the key limiting the expansion of the stud come into action.

Advantageously, said membrane, said stud as well possibly as said key may form one and the same piece made from a resiliently deformable material such for example as an elastomer.

The stud may have a cylindrical and/or truncated cone shape whose large base, which merges with the membrane, bears on a resiliently deformable element of the switch.

Of course, the tactile effect sought may be obtained by an appropriate choice of the modulus of elasticity of the elastomer, of the shape and height of the stud as well as of the dimensions and conformation of the key.

The limiting means may in particular consist of a cavity formed in the lower face of the key and in which the stud is engaged, this cavity being formed so as to allow free expansion of the stud in the pre-travel phase and containing the expansion at least partially at the end of the over-travel phase.

The resiliently deformable element of the switch may be a blade or cup with detent effect which is only deformed resiliently from a given force threshold.

As mentioned above, the invention also relates to a keyboard formed from the above defined key.

In this case, said support may be in the form of a plate, for example a printed circuit board, having a plurality of recesses each adapted for receiving a switch element. This plate is then covered by said membrane which comprises, at the level of each of the recesses a resilient deformable stud which can be actuated by a key.

BRIEF DESCRIPTION OF THE DRAWINGS

One embodiment of the invention will be described hereafter, by way of example, with reference to the accompanying drawings in which.

DESCRIPTION OF THE PREFERRED EMBODIMENT

Figure 1:
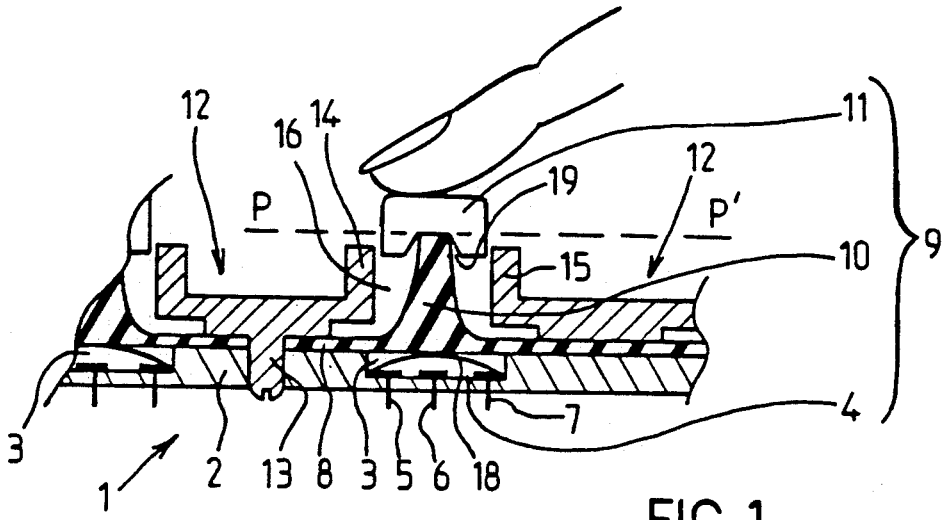
FIG. 1 is a schematic cross section of a keyboard portion including a tactile effect key according to the invention, in the rest position.
Figure 2:
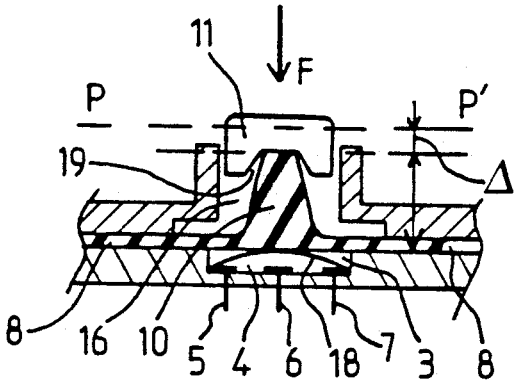
FIGS. 2 to 4 are views of a key according to FIG. 1 during operation, in particular, at the end of the pre-travel (FIG. 2), at the end of the effective travel (FIG. 3) and at the end of the over-travel (FIG. 4)
Figure 3:
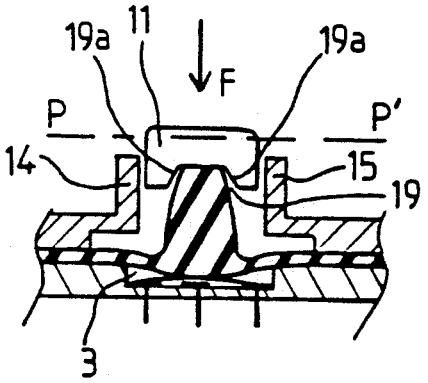
Figure 4:
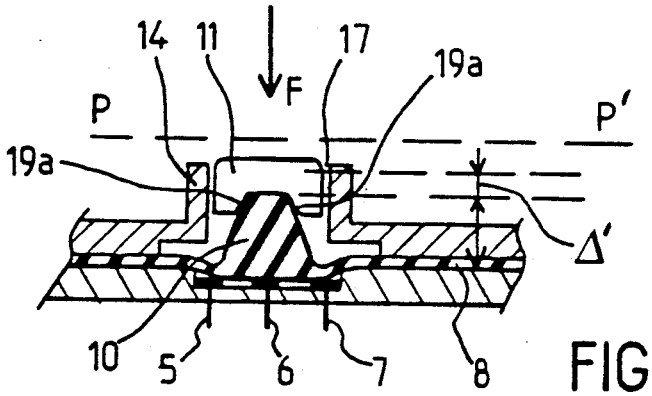

The keyboard portion 1 shown in FIG. 1 comprises a support plate 2 formed by a printed circuit in particular for the electric connection of said keyboard 1 to an apparatus (not shown).

The support plate 2 has a plurality of recesses 3 disposed in lines and/or columns. Each of these recesses 3 forms the housing for a switch 4 formed of conducting elements or contacts 5, 6, 7 disposed at the bottom of recesses 3 and able to cooperate by electric contact with a resiliently deformable conducting blade 18 and acting by detent effect, so as to establish connection of contact 6 with contacts 5 and 7.

Recesses 3 are formed under the upper plane of the support plate 2 or printed circuit on which is disposed a membrane 8 forming deformable means which, associated with a key-pusher-switch assembly, 9 gives the user a tactile feeling.

According to the invention, membrane 8 is solid, i.e. has no opening permitting one of the elements of assembly 9 to pass therethrough. It is made from an elastomer material and is provided with as many studs 10 as there are switches 4 to be controlled. Studs 10 are deformable axially under compression. They are integrally molded with said membrane 8 and are adapted to be inserted, when the latter is fitted, between a key 11 and switch 4 so as to form a pusher.

Membrane 8 thus formed is fixed on the support plate 2 so that each of the studs is in the axis of a corresponding recess 3. In this example, such fixing is provided by an apertured structure 12 having the form of a grid, comprising a plurality of cavities 16 separated by dividing walls 14, 15, this structure 12 being disposed on membrane 8 and fixed on the support plate 2 by fixing means such as hot crimping elements 13 or even screws, not shown. Of course, each of cavities 16 is intended to receive a corresponding stud 10 and provide axial guiding of the key 11 associated with this stud 10.

As can be seen in FIG. 1, at rest key 11 fast with the end of stud 10 projects slightly beyond the upper orifice 17 of cavity 16. The pusher 11/switch 4 mechanical connection is provided by the fact that blade 18 bears slightly on the zone of membrane 8 forming the base of stud 10.

Stud 10 or pusher is thus formed of a mass of elastomer with substantially truncated cone shaped variable cross section whose large base is merged with the membrane 8. Preferably, the modulus of elasticity of this elastomer is chosen relatively low.

Figure 5:
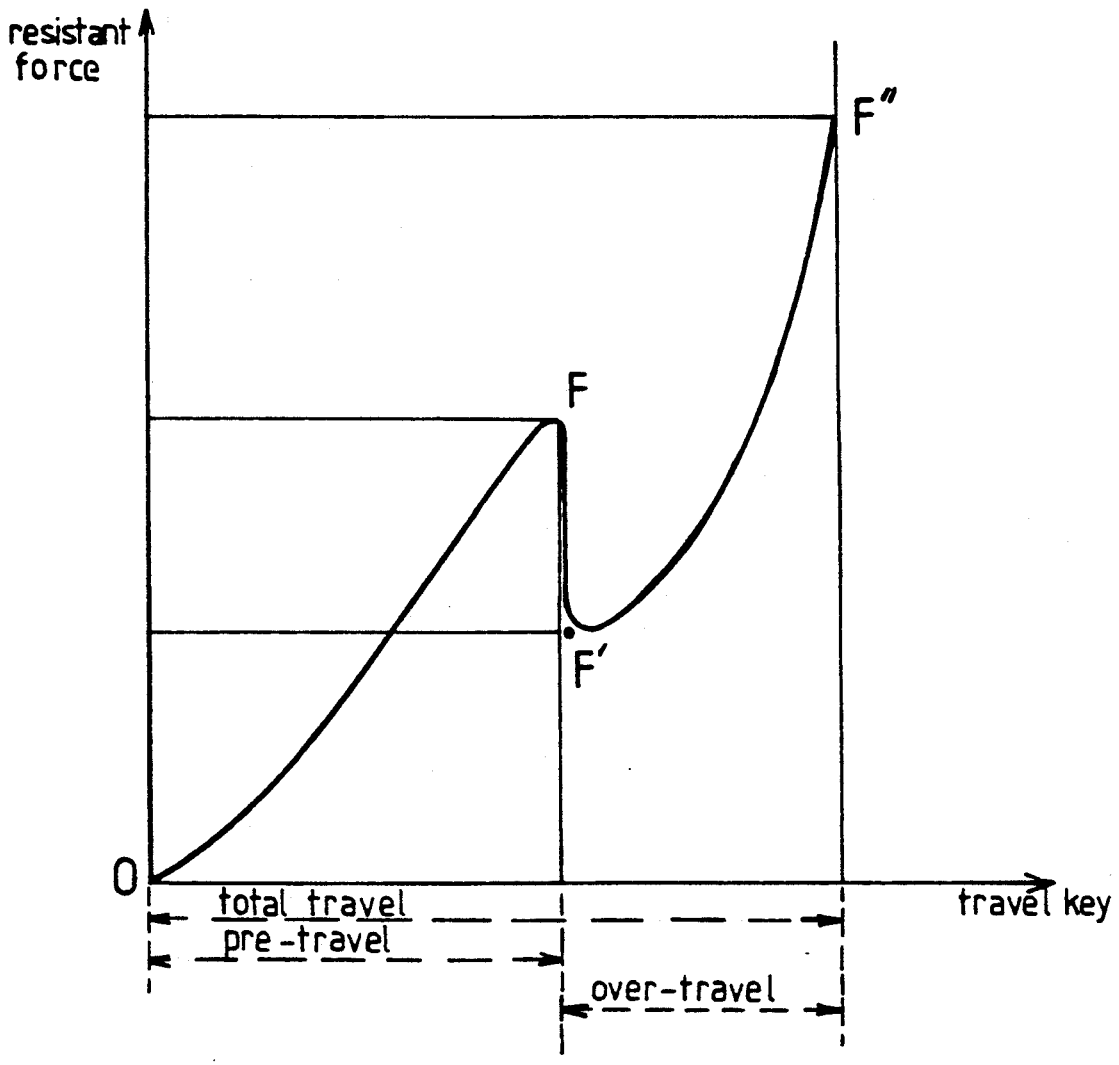
FIG. 5 is a compression curve (resistance force versus travel) of a key according to the invention.

From the rest position shown in FIG. 1, application on key 11 of an axial force F of sufficient amplitude causes movement of this key in three stages, namely:

a first stage in which key 11 effects a first movement OF (pre-travel shown in FIG. 5) causing the compression (with free expansion) of stud 10 without causing appreciable deformation of the resilient blade 18; during this first movement, the resistant force is substantially proportional to the travel of key 11 up to a first threshold value;

a second stage (active travel) in which the travel F, F′ of the key is practically zero, the resilient deformation of the resilient blade 18 which causes actuation of switch 4 being compensated for by expansion of the elastomer of the stud; during this second stage, the resistant force decreases suddenly and is felt as a release;

a third stage (over-travel) in which the travel F′, F″ of the key is again essentially due to crushing of the stud 10 with progressive increase of the resistant force at the beginning of the over-travel (free expansion of the material of stud 10, then with sudden increase of the resistant force at the end of the over-travel) contained expansion of the material of stud 10.

In fact, during this second over-travel phase, the resilient blade 18 is kept applied against the contacts 5, 6, 7 and undergoes no deformation. The rapid increase of the resistant force being then due to the means limiting the expansion of stud 10 equipping the pusher coming into action.

In this example, these means for limiting the expansion of stud 10 are formed by a lower cavity 19 of the key 11 in which stud 10 is housed and centered. The dimensions and form of cavity 19 are such that they allow its free expansion in the pre-travel phase OF corresponding to the crushing Δ (measured with respect to the reference plane PP′ of the top of the stud 10 in the rest position) and contain said expansion during the over-travel F′, F″ corresponding to crushing Δ′ for a predetermined volume of stud 10 corresponding to that of cavity 19 whose edges **19*a* are in this case chamfered. At this end of travel stage, key 11 is completely pushed into cavity 16 of structure 12**.

Of course, the invention is not limited to the embodiment described above. Thus, for example, the structure 12 could be omitted.

It is important to emphasize that an important advantage of the solution provided by the present invention is that it avoids all dangers of breakage and sticking of moving parts which are known in mechanical so-called "pump" controls comprising several parts, springs, shafts, mobile parts, etc . . . , while keeping the ergonomic contact characteristics during the whole travel time.

What is claimed is:

1. A tactile effect switch comprising:

a support having a recess adapted for receiving a switching device having a snap acting control element which can be significantly moved, while exerting a low resistant force, only under the effect of a pressure exceeding a given threshold;

a resilient membrane integral with the support which forms a cap closing the recess, this membrane having, on the side opposite the recess and substantially coaxially therewith, a resiliently deformable solid stud which serves as pusher, said stud being made from a resiliently deformable material with a low modulus of elasticity, a key associated with the pusher, on which said pressure may be exerted for actuating the control element, said key having a concave shape partially surrounding the stud so as to limit the expansion of said stud from a given expansion rate, and to obtain the following successive operating phases:

a pre-travel phase during which said resistant force which is transmitted by the key increases progressively until said pressure reaches the threshold, an active phase during which said resistant force decreases suddenly, the key effecting a travel which is practically zero and the control element is subjected to an actuation due to partial expansion of the material of the stud while producing a feeling of release, an over-travel phase at the beginning of with the resistant force increases again progressively then rises suddenly when the concave shape of the key limiting the expansion of the stud comes into action.

2. The switch as claimed in claim 1, wherein said membrane and said stud form one and the same piece made from a resiliently deformable material.

3. The switch as claimed in claim 1, wherein said stud has a cylindrical and/or truncated cone shape whose large base, which emerges with the membrane, bears on a resiliently deformable control element of the switching device.

4. The switch as claimed in claim 1, wherein said concave shape forms a cavity in a lower face of the key in which the stud is engaged, said cavity being formed so as to allow free expansion of the stud in the pre-travel phase and to contain the expansion at least partially at the end of the over-travel phase.

5. The switch as claimed in claim 3, wherein the control element of the switching device consists of a cup with detent effect which is only deformed resiliently from a given force threshold.

6. A keyboard using switches such as claimed in claim 1, wherein said support is in the form of a plate having a plurality of recesses each adapted for receiving a switching device, said plate being then covered by a membrane which comprises, at the level of each of the recesses, a resiliently deformable stud which can be actuated by a key having a concave shape which limits the expansion of the material of the stud.

7. The keyboard as claimed in claim 6, wherein the plate is a printed circuit board.

* * * * *